US010286240B2

(12) United States Patent
Cerruti

(10) Patent No.: US 10,286,240 B2
(45) Date of Patent: May 14, 2019

(54) AUTOMATIC NOZZLE FOR FIREFIGHTING SYSTEMS

(71) Applicant: ETEA SICUREZZA GROUP LTD, London (GB)

(72) Inventor: Ferruccio Cerruti, Saluzzo (IT)

(73) Assignee: ETEA SICUREZZA GROUP LTD, London (GB)

( * ) Notice: Subject to any disclaimer, the term of this patent is extended or adjusted under 35 U.S.C. 154(b) by 132 days.

(21) Appl. No.: 15/513,960

(22) PCT Filed: Oct. 14, 2015

(86) PCT No.: PCT/IB2015/057858
§ 371 (c)(1),
(2) Date: Mar. 23, 2017

(87) PCT Pub. No.: WO2016/059561
PCT Pub. Date: Apr. 21, 2016

(65) Prior Publication Data

US 2017/0281998 A1 Oct. 5, 2017

(30) Foreign Application Priority Data

Oct. 15, 2014 (IT) ..... TO2014A0834

(51) Int. Cl.
*B05B 1/14* (2006.01)
*B05B 1/26* (2006.01)
(Continued)

(52) U.S. Cl.
CPC ..... *A62C 37/14* (2013.01); *A62C 31/05* (2013.01); *A62C 37/11* (2013.01);
(Continued)

(58) Field of Classification Search
CPC ..... B05B 1/14; B05B 1/265; B05B 1/3006; A62C 31/05; A62C 37/11; A62C 37/14; A62C 99/0072
(Continued)

(56) References Cited

U.S. PATENT DOCUMENTS 9,821,179 B2 * 11/2017 Kristensen ..... B05B 1/14
2011/0121099 A1 * 5/2011 Han ..... A62C 31/05 239/263

FOREIGN PATENT DOCUMENTS

CN 201 197 856 Y 2/2009

* cited by examiner

*Primary Examiner* — Jason J Boeckmann
(74) *Attorney, Agent, or Firm* — R. Ruschena Patent Agent, LLC

(57) ABSTRACT

An automatic nozzle for firefighting low-pressure water mist systems comprising a nozzle body and shutter means, said nozzle body comprising a plurality of axial-symmetric components defining an inlet opening and a plurality of inner cavities, which are fluid-dynamic connected each other by means of one or more openings, being said components configured to generate a radial spray through a circumferential opening, which extends all over the circumference of a second component, said circumferential opening being formed between a base of an annular board of the second component and an upper surface of a hollow body of a third component, and two or more full cone sprays by means of the fluid passage through cylindrical openings on a circular and axial-symmetric body of a fifth component, configured to define a turbulent motion of the fluid in at least two correspondent cylindrical cavities of a fourth component.

11 Claims, 6 Drawing Sheets

(51) Int. Cl.

| | |
|---|---|
| ***B05B 1/30*** | (2006.01) |
| ***A62C 31/05*** | (2006.01) |
| ***A62C 37/11*** | (2006.01) |
| ***A62C 37/14*** | (2006.01) |
| ***A62C 99/00*** | (2010.01) |

(52) U.S. Cl.
CPC ..... *A62C 99/0072* (2013.01); *B05B 1/14* (2013.01); *B05B 1/265* (2013.01); *B05B 1/3006* (2013.01)

(58) Field of Classification Search
USPC ..... 169/37
See application file for complete search history.

AUTOMATIC NOZZLE FOR FIREFIGHTING SYSTEMS

BACKGROUND OF THE INVENTION

1. Field of the Invention

The present invention relates to an automatic nozzle, for firefighting systems employing water mist at low pressure. With the term low pressure is intended a pressure not greater than 12.5 bar. With water mist is intended a cone spray of water having at least 90% of the droplets at 1 m distance from the nozzle characterized by a diameter smaller than 1 mm.

2. Brief Description of the Prior Art

Water mist nozzles for firefighting systems are known and are called "sprinkler". The sprinkler is an automatic rain extinguishing system, which has the purpose of detecting the presence of a fire. A sprinkler system generally includes a water supply and a network of pipes, usually positioned at the level of the ceiling or roof, to which are connected, with proper spacing, discharge nozzles closed by a thermo-sensitive element. In such systems, a spray of water is conveyed into nozzles within which is divided into a spray of droplets. A problem of "sprinkler" firefighting systems is that they require relatively large amounts of water to be distributed to extinguish fires in an effective manner, and therefore require large water reserves.

An alternative solution is represented by systems having nebulized water at high pressure, which operate with water input pressures greater than 35 bar and typically between 100 and 120 bar. This solution implies a series of drawbacks the main of which is linked to complexity and cost of the system; in fact, pumps and components of the water supply system must be designed and produced with materials suitable to operate at high pressures.

Another problem of high pressure spray systems is that the nozzles have small orifices, to create droplets of suitable size. The small holes of the nozzle make it very sensitive to clogging by impurities, which are present in water and pipes. Therefore, it is necessary to make sure that components of the supply system are internally free of solid particles and ensure that the used materials have a high corrosion resistance, since said corrosion could generate solid particles that can clog the nozzle orifices. Finally, the small size of the drops generated by high pressure systems and, accordingly, the small mass that characterizes them, make this technology unsuitable to extinguish fires at high power thermal emissions. In fact, the droplets tend to be easily taken away from flames by air upward movements around the fire. Thus the droplets cannot reach and cool the fuel.

SUMMARY OF THE INVENTION

The above problem has been solved by introducing firefighting systems having low pressure water mist. These systems can work with simpler components from materials and costs point of view: in practice, same components of sprinkler systems can be adopted. However, in these systems, the water fed at low pressure is provided with low kinetic energy: for this reason, it is not possible to get a water spray sufficiently atomized, which, at the same time, completely fills the exit cone of the nozzle. Invention summary Aim of the present invention is to realize an automatic nozzle for firefighting low pressure water mist systems, which is free from the above described drawbacks. In particular, the automatic nozzle of the present invention is characterized by two distinct sprays of water: a radial spray, generated through a slot which circumferentially extends around the nozzle body, and two or more full cone sprays, which develop internally in the radial spray and generated by two or more orifices, which enable the atomized spray of water to be effectively distributed for a rapid extinction of the fire.

According to the present invention an automatic nozzle for firefighting low-pressure water mist systems is disclosed, presenting the characteristics as defined in the enclosed independent claim.

Further embodiments of the invention, preferred and/or particularly advantageous, are described according to the characteristics as in the enclosed dependent claims.

BRIEF DESCRIPTION OF THE DRAWINGS

The present invention will be now described by reference to the enclosed figures, which show some non-limitative embodiments, in which.

DETAILED DESCRIPTION OF THE PREFERRED EMBODIMENTS

With reference to the above figures an automatic nozzle for firefighting low-pressure water mist systems, according to a preferred embodiment of the invention is referenced as a whole with 10.

Figure 1:
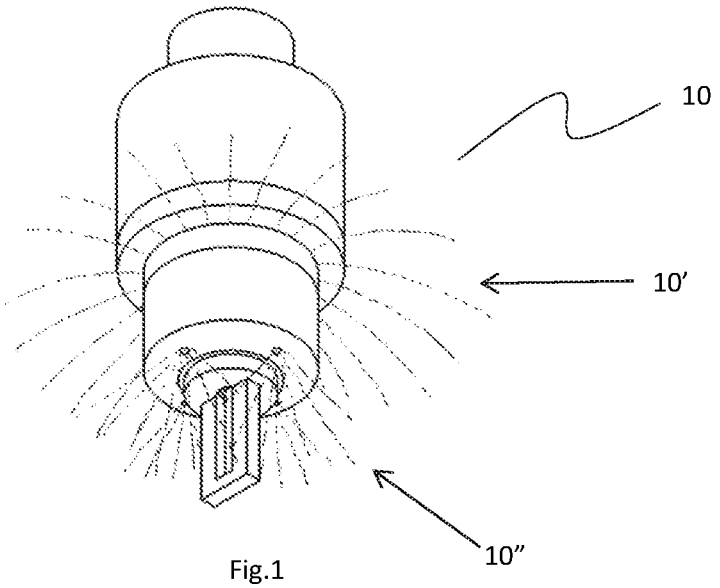
FIG. 1 is a 3D view of a nozzle according to a preferred embodiment of the present invention.

The automatic nozzle 10 is able to realize two distinct sprays of water, as shown in FIG. 1: a radial spray 10', generated through a slot which extends circumferentially around the nozzle body, and two or more full cone sprays 10", which develop internally in the radial spray and generated by two or more orifices, for protection against fire in confined spaces and open spaces, for applications in land and sea, for cooling facilities and for protection of individual machines.

Figure 2:
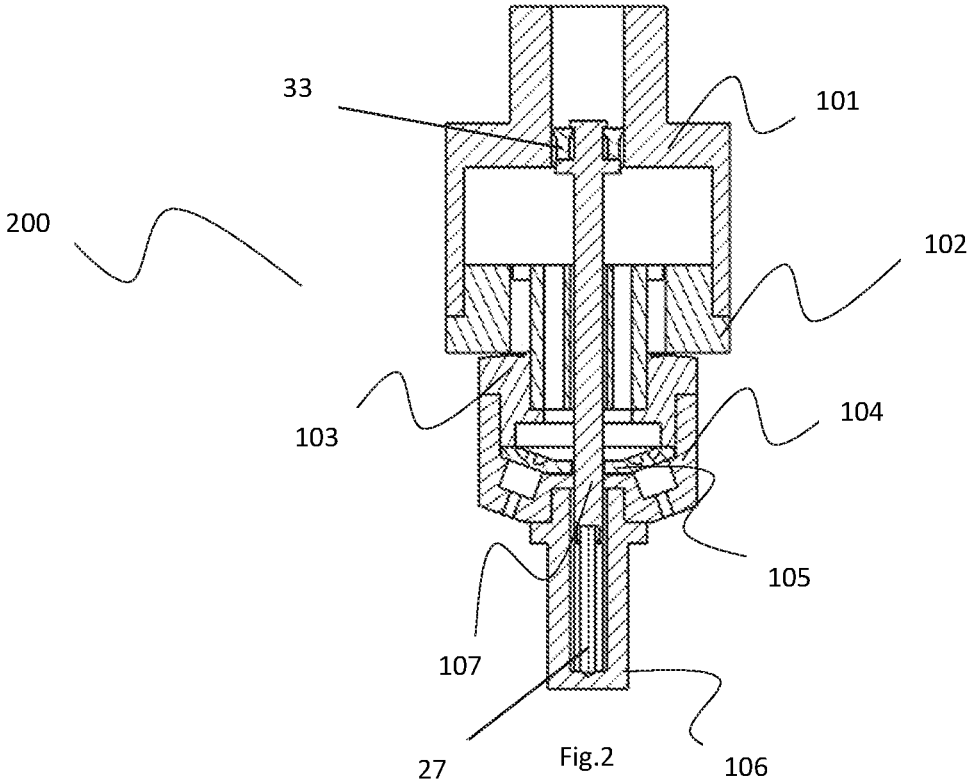
FIG. 2 is a cross section of the nozzle of FIG. 1.

With reference to FIG. 2, the automatic nozzle 10 comprises a nozzle body 200 and shutter means 107, said nozzle body 200 comprising a plurality of axial-symmetric components 101-106 defining an income opening and a series of internal cavities which are fluid-dynamically connected to each other by means of one or more openings, said components being 101-106 arranged so as to share the same axis of symmetry and configured to generate the fluid sprays 10' and 10".

Figure 3:
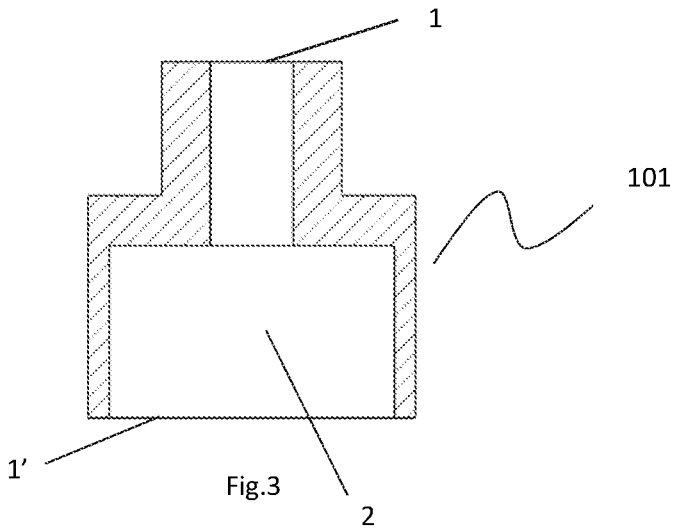
FIG. 3 is a cross section of a first component of the nozzle of FIG. 1.

As shown in FIG. 3, a first component 101 is a hollow body provided with two openings: a first opening 1, through which flows the water that fills an inner cavity 2, and a second opening 1' by means of which the water is distributed in the openings of a second component 102 to which the first component 101 is steadily connected. Said second component 102 comprises a cylindrical central body 3 provided with an opening 4, coaxial to the cylindrical central body 3 passing through it for its entire length, and an annular edge 6 coaxial with the cylindrical central body 3 and having a lesser height.

Figure 4:
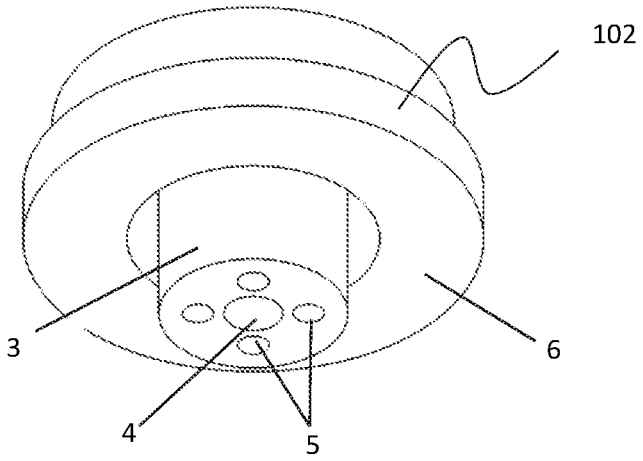
FIG. 4 is a 3D view of a second component of the nozzle of FIG. 1, FIG. 5 comprises a plane view and a cross section of the second component of the nozzle of FIG. 1.
Figure 5:
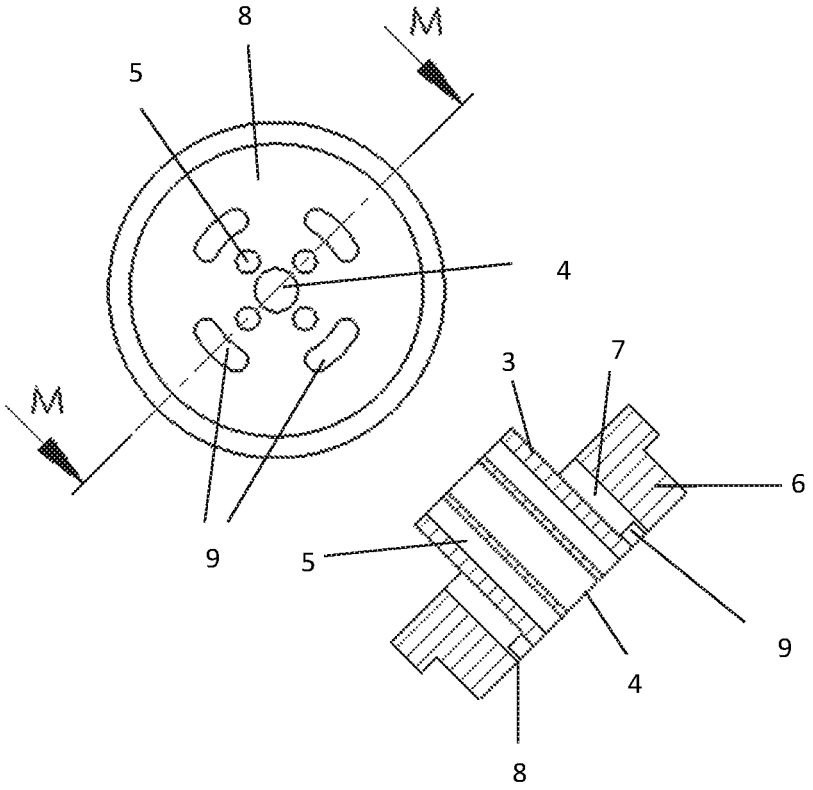

As shown in FIGS. 4 and 5, in addition to the opening 4, in the cylindrical central body 3 are present one or more non-coaxial openings 5 that cross the cylindrical central body 3 for its entire height. The cylindrical central body 3 and the annular edge 6 create an annular cavity 7 closed on one side by a wall 8 and open on the opposite side, i.e. the side where the third component 103 is steadily connected. In addition, the wall 8 is crossed by one or more openings 9.

Figure 6:
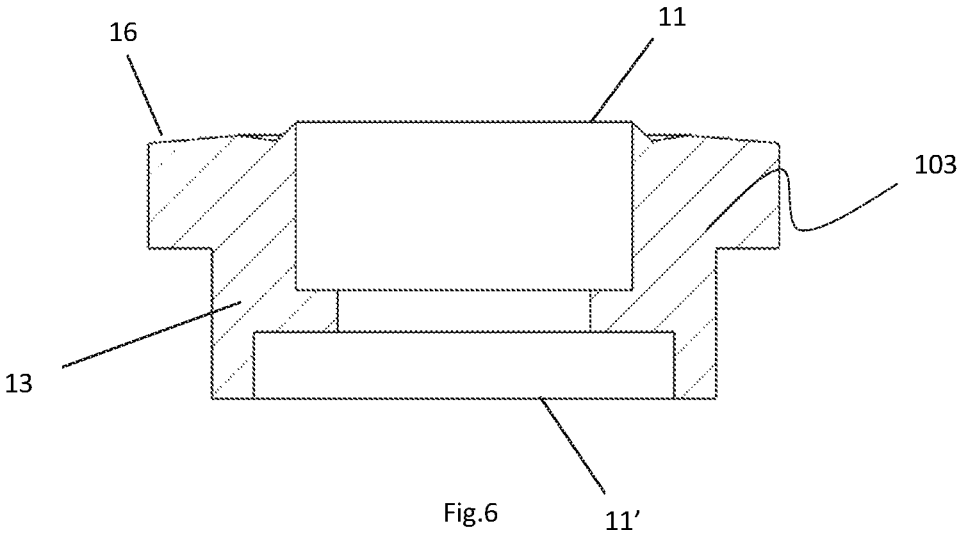
FIG. 6 is a cross section of a third component of the nozzle of FIG. 1.

The second component 102 is steadily connected by means of the cylindrical central body 3 to the third component 103. The latter, shown in FIG. 6, comprises a hollow body 13 having an upper opening 11 and a lower opening 11'.

Figure 7:
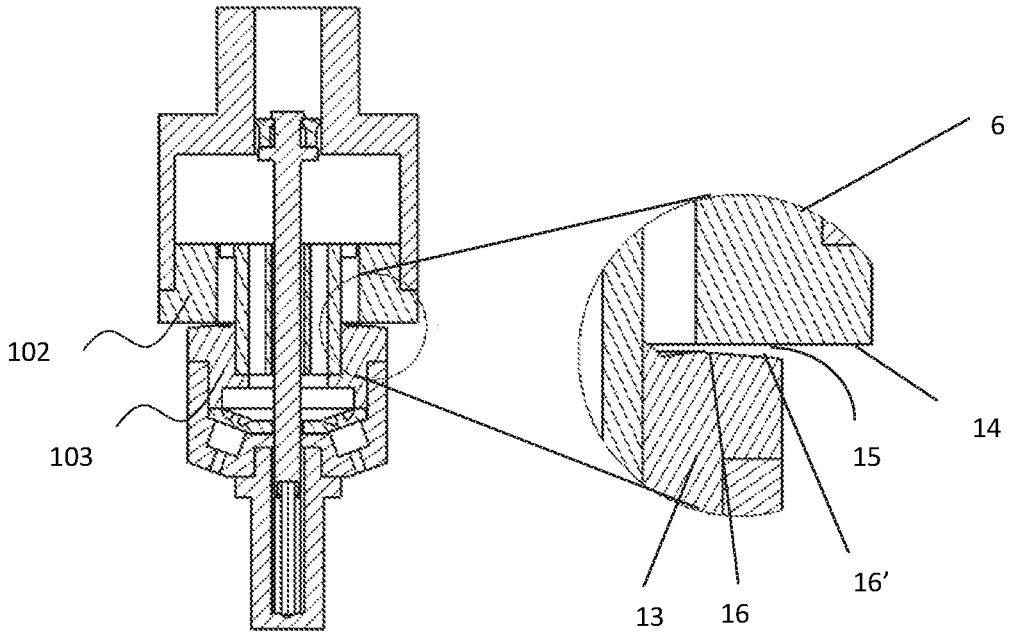
FIG. 7 is a detail of the cross section of the nozzle of FIG. 1.

As visible in FIG. 7, during the assembly process of said second 102 and third component 103, a part of the cylindrical central body 3 of the second component 102 is inserted in the hollow body 13 of the third component 103, through its upper opening 11. The second component 102 is made in such a way that, once connected to the third component 103, a base 14 of the annular edge 6 forms a circumferential opening 15 (extending for the whole circumference of the second component 102) with an upper surface 16 of the hollow body 13 of the third component 103.

Figure 8:
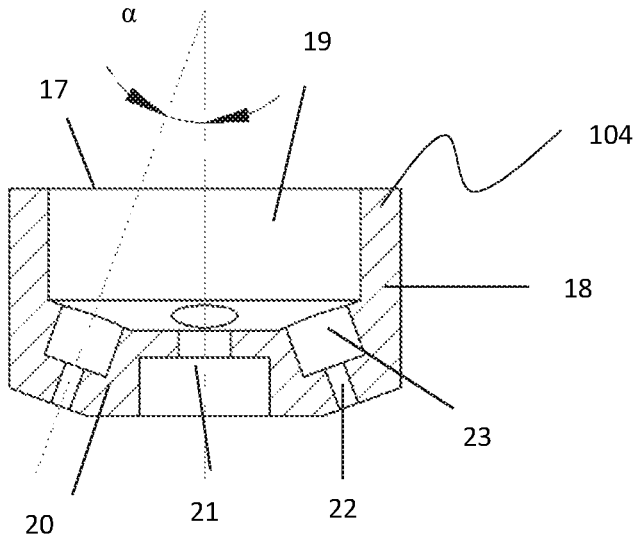
FIG. 8 is a cross section of a fourth component of the nozzle of FIG. 1.
Figure 9:
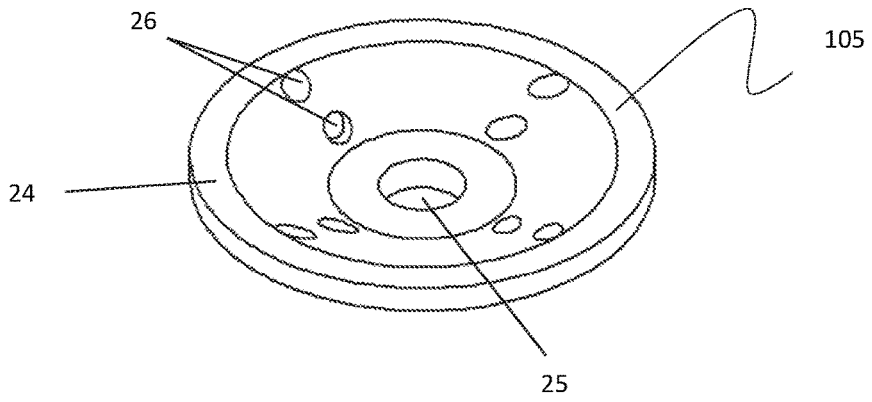
FIG. 9 is 3D view of a fifth component of the nozzle of FIG. 1, FIGS. 10*a* and 10*b* show two details of the fifth component of the nozzle of FIG. 1.

As illustrated in FIG. 8, the third component 103 is steadily connected to a fourth component 104 which comprises an axial-symmetric hollow body 18 defining an internal cavity 19 and provided with an upper opening 17. In the nozzle assembly such upper opening 17 connects the internal cavity 19 of the fourth component 104 with the cavity of the third component 103, through its lower opening 11'. On a wall 20 are formed a cylindrical central opening 21 coaxial with the fourth component 104, and two or more orifices 22, non-coaxial, communicating with the corresponding cylindrical cavities 23 formed in the wall of the fourth component 104, open on the opposite side with respect to the orifices 22 and having a diameter greater than the diameter of the same orifices 22. The axis of the orifices 22 is inclined with respect to the axis of the fourth component 104 by an angle a ranging between 10° and 80°. On the internal wall of the internal cavity 19 of the fourth component 104, opposite to the open side, a fifth component 105 is steadily connected. As shown in FIG. 9, the fifth component comprises a circular and axial-symmetric body 24, having a thickness less than the maximum diameter of the same axial-symmetric body 24 and a central passing-through opening 25.

Figure 10A:
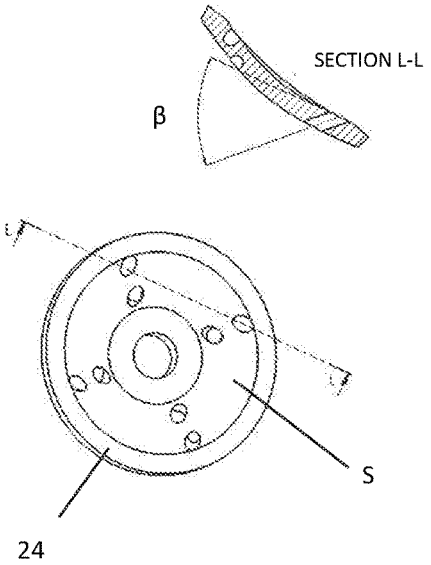

Laterally with respect to the central opening of the fifth component 105 cylindrical openings 26 are formed. Said cylindrical openings 26 are fluid connected to the internal cavity 19 of the fourth component 104. On the fifth component 105, for each orifice 22 there are two corresponding cylindrical openings 26, both inclined of an angle β (FIG. 10*a*) ranging between 10° and 80°. The angle β is the inclination of the axis of each cylindrical opening 26 with respect to an upper surface S of the fifth component 105.

Moreover, said two corresponding cylindrical openings 26 are axial-symmetrically located with respect to the correspondent orifice 22.

Figure 10B:
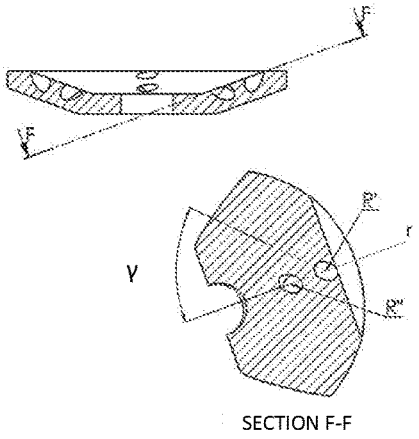

Furthermore, to optimize the fluid dynamics of the liquid before it reaches the orifices 22 and improve the subsequent nebulization, the axis of each of the cylindrical openings 26 has a second inclination towards the axis of the correspondent orifice 22, by an angle γ ranging between 30° and 90° (FIG. 10*b*). Defined a plan FF as tangent to the upper surface S and passing through the intersection points R' and R" (intersection between the upper surface S and the axes of the pair of cylindrical openings 26 corresponding to the same orifice 22), the angle γ is the acute angle, identified on the plane FF, between the projection of the axis of each cylindrical opening 26 on the plane FF and the straight line r, passing through the intersection points R' and R".

A sixth component 106, positioned in correspondence of the cylindrical central opening 21 of the fourth component 104 and steadily connected to it, retains on one side a thermal bulb 27, axially arranged, which is pushed from the opposite side of the shutter means 107.

Figure 11:
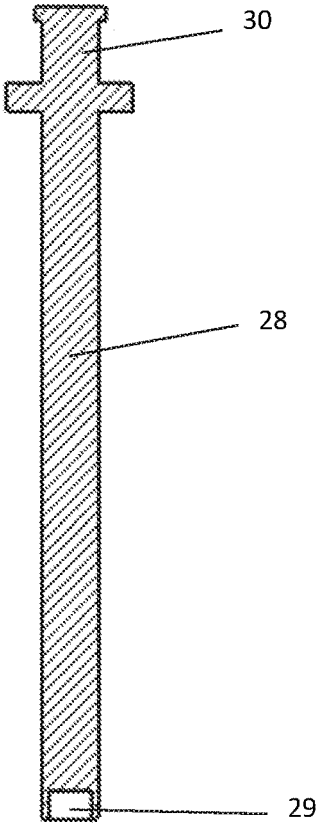
FIG. 11 is a cross section of shutter means of the nozzle of FIG. 1.

As shown in FIG. 11, the shutter means 107 comprise a cylindrical body 28 which crosses all the components 101-106 of the nozzle body 200 and is coaxial to them. Said shutter means further comprise at the lower end a cavity 29 suitable to house an end of the thermal bulb 27 and at the upper end a seat 30 suitable to keep in the correct position sealing means 33. Said sealing means 33 adhering to the inner walls of the second opening 1' of the first component 101 prevent the passage of water when the bulb is intact.

In case of fire, the heat causes the explosion of the thermal bulb 27. Subsequently, the shutter means 107 and the sealing means 33 connected thereto are pushed by the water pressure, through the first opening 1 of the first component 101, filling the cavity 2. Therefore, the water can reach the annular cavity 7 of the second component 102 through its one or more openings 9 and the internal cavity 19 of the fourth component 104, through the non-coaxial openings 5 of the cylindrical central body of the second component 102. The water from the annular cavity 7 reaches the circumferential opening 15 between the second component 102 and the third component 103, generating the radial jet 10'. Instead, the water in the cavity of the fourth component 104 passes through the cylindrical openings 26 formed on the fifth component 105, which impart a swirling motion in the corresponding cylindrical cavities 23 formed in the fourth component 104 so that, coming out from the nozzle through the two or more orifices 22, generate a full cone water mist spray 10".

Figure 12:
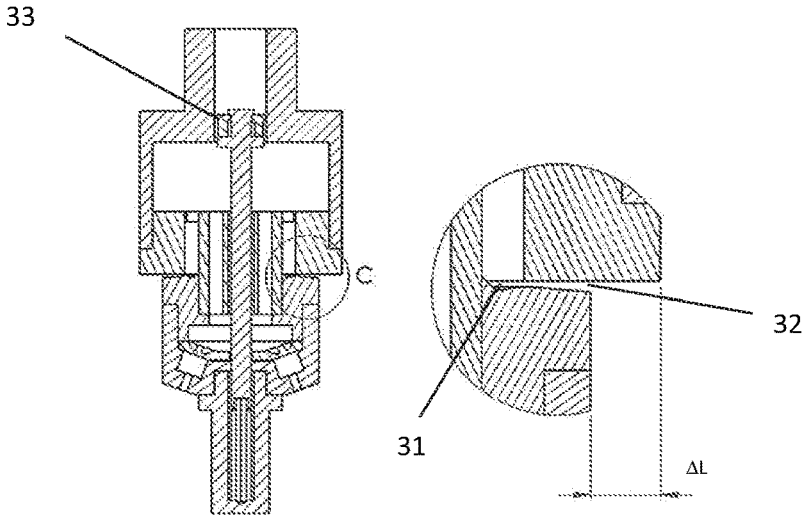
FIG. 12 is a detail of the cross section of the nozzle of FIG. 1.

To reduce the likelihood that the opening which generates the radial jet may become clogged (for example, during the step of mounting the nozzle), the surfaces that form the circumferential opening 15 have outer radii which differ for a length ΔI__ greater than or equal to 1 mm, as shown in FIG. 12.

Obviously, the amount of removed heat depends on the volume of water and the diameter of the droplets of water: smaller droplets, with the same water amount, are able to extract more heat due to a more advantageous surface/volume ratio. In addition, to be able to penetrate into the flames, the droplets of water mist must possess speed and mass such as to overcome the turbulence of the flue gases emitted by the flames.

The main target of the of the nozzle design is to minimize the operating pressure and the flow rate of the required water, obtaining at the same time a sufficient amount of water droplets with adequate speed and mass. The minute droplets of water can be generated from a suitable atomization, which can be defined as the breaking of the liquid in a light mist which is suspended in the air.

The atomization in the nozzle is obtained by forming an appropriate swirling motion of the liquid. For this purpose, the upper surface 16 of the hollow body 13 of the third component 103, which contributes to the opening of the radial spray is not flat. On the contrary, the radially inner surface 16' is shaped so as to create a recess 31 with the annular edge 6 of the second component 102; this recess 31 allows the creation of vortices in the annular cavity 7 which improve the nebulization of the water at the exit of the circumferential opening 15. The radially outer surface 16" is inclined so that the width of the cross section of the gap 32, which creates the radial spray, gradually grows in the water outflow direction, favoring the breaking of the water film in drops of small size.

The use of these automatic nozzles allows to acquire firefighting low-pressure water mist systems both the benefits of sprinkler firefighting systems and high-pressure water mist systems. In fact, such low-pressure systems utilize components normally used in the common sprinkler firefighting systems and at the same time ensure for fire protection performance and advantages comparable to those of high-pressure water mist systems.

As already mentioned, such automatic nozzle creates a fine dispersion of droplets that quickly evaporating due to the high surface/volume ratio is able to quickly absorb heat; in addition, the homogeneous atomization generated from the nozzle contains the heat radiation of the flames and contributes to smother the fire, by means of a partial process of oxygen replacement with water in the area surrounding the fire.

The automatic nozzle according to the invention and the related low-pressure water mist system, inclusive of pump means, means for feeding water and means for intercepting water, is suitable for, and however not limited to, the protection of industrial and civil buildings, warehouses, machinery and paper archives.

Other than the embodiments of the invention, as above disclosed, it is to be understood that a vast number of variations exist. It should also be appreciated that the exemplary embodiment or exemplary embodiments are only examples and are not intended to limit the scope, applicability, or configuration in any way. Rather, the foregoing summary and detailed description will provide those skilled in the art with a convenient road map for implementing at least one exemplary embodiment, it being understood that various changes may be made in the function and arrangement of elements described in an exemplary embodiment without departing from the scope as set forth in the appended claims and their legal equivalents.

The invention claimed is:

1. An automatic nozzle (10) for firefighting low-pressure water mist systems comprising a nozzle body (200) and shutter means (107), said nozzle body (200) comprising a plurality of axial-symmetric components (101-106) defining an inlet opening and a plurality of inner cavities, which are fluid-dynamic connected each other by means of one or more openings, being said components (101-106) located in a way to share the same symmetry axis and configured to generate:

a radial spray (10') through a circumferential opening (15), which extends all over the circumference of a second component (102), said circumferential opening (15) being formed between a base (14) of a cylindrical wall of the second component (102) and an upper surface (16) of a hollow body (13) of a third component (103), and two or more full cone sprays (10") by means of the fluid passage through cylindrical openings (26) on a circular and axial-symmetric body (24) of a fifth component (105), configured to define a turbulent motion of the fluid in at least two correspondent cylindrical cavities (23) of a fourth component (104), said two or more full cone sprays (10") out coming through at least two orifices (22) fed by the at least two correspondent cylindrical cavities (23), wherein said axis of each of said cylindrical openings (26) of the fifth component (105) is inclined of a first angle (β) ranging between 10° and 80° with respect to an upper surface (S) of the circular and axial-symmetric body (24), the axis of each of said cylindrical openings (26) has a second inclination of a second angle (γ) ranging between 30° e 90° and laying on a plane (FF), which is tangent to the upper surface (S) of the circular and axial-symmetric body (24) and contains the intersection points (R', R) between the upper surface (S) and the axis of said cylindrical openings (26) converging towards a same orifice of the two or more orifices (22), said second angle (γ) being comprised between the projection of the axis of said cylindrical openings (26) on the plane (FF) and a straight line (r), passing through the intersection points (R', R");

and wherein said cylindrical openings (26) fluid-dynamically connect an internal cavity (19) of the fourth component (104) with cylindrical cavities (23) of the same fourth component (104), localized upstream of the at least two orifices (22).

2. The automatic nozzle (10) according to claim 1, wherein said upper surface (16) of the hollow body (13) of the third component (103) and said base (14) of an annular edge (6) of the second component (102) have correspondent external radius which differ of a length (ΔI_) greater or equal to 1 mm.

3. The automatic nozzle (10) according to claim 1 wherein said upper surface (16) of the hollow body (13) of the third component (103), creating the circumferential opening (15) of the radial spray (10'), in its radially inner portion is shaped to form a recess (31) with the annular edge (6) of a cylindrical central body (3) of the second component (102), to create in an annular cavity (7) fluid vortexes, which improve water nebulization at the exit of the circumferential opening (15).

4. The automatic nozzle (10) according to claim 1, wherein said upper surface (16) of the hollow body (13) of the third component (103) comprises a radially outer surface (16"), forming a gap (32), whose width gradually increases toward the water exit, to break the water layer in small droplets.

5. The automatic nozzle (10) according to claim 1, wherein said at least two or more orifices (22) are inclined of an angle (a) ranging between 10° and 80° with respect to the symmetry axis of the fourth component (104).

6. The automatic nozzle (10) according to claim 1, wherein said second component (102) comprises the cylindrical central body (3) having an opening (4), which is co-axial to the cylindrical central body (3) and crosses the cylindrical central body (3) all over its length, and the annular edge (6), co-axial to the cylindrical central body (3) and having a smaller height than the cylindrical central body (3).

7. The automatic nozzle (10) according to claim 6, wherein said cylindrical central body (3) of the second component (102) comprises one or more not co-axial openings (5), which cross the cylindrical central body all over its length.

8. The automatic nozzle (10) according to claim 6 wherein said cylindrical central body (3) and the annular edge (6) create an annular cavity (7), which is closed on one side by a wall (8) and open on the opposite side, where the third component (103) is steadily connected.

9. The automatic nozzle (10) according to claim 1, wherein said fifth component (105) comprises the circular and axial-symmetric body (24), having a thickness smaller than the maximum diameter of said circular and axial-symmetric body (24) and a central passing-through opening (25), which completely crosses the circular and axial-symmetric body (24).

10. The automatic nozzle (10) according to claim 1, wherein said shutter means (107) comprise a cylindrical body (28), crossing all components (101-106) of the nozzle body (200) and is co-axial to said further components.

11. The automatic nozzle (10) according to claim 10, wherein said shutter means (107) comprise at the lower end a cavity (29), which is suitable to accommodate an end of a thermal bulb (27) and at the upper end a seat (30), which is suitable to accommodate sealing means (33), which, adhering at the inner walls of a second opening ( ) of a first component (101), prevent water passages, when the thermal bulb (27) is not broken.

* * * * *